US005818393A

United States Patent [19]

Fowler et al.

[11] Patent Number: 5,818,393

[45] **Date of Patent: *Oct. 6, 1998**

[54] WIDE FIELD-OF-VIEW FIXED BODY CONFORMAL ANTENNA DIRECTION FINDING ARRAY

[75] Inventors: William Douglas Fowler, Plano; Stephen David Levin, Richardson, both of Tex.; Brian Sean Brown, Wauwatosa, Wis.

[73] Assignee: Raytheon TI Systems, Inc., Lewisville, Tex.

[ * ] Notice: The term of this patent shall not extend beyond the expiration date of Pat. No. 5,793,332.

[21] Appl. No.: 485,204

[22] Filed: Jun. 7, 1995

Related U.S. Application Data

[63] Continuation of Ser. No. 44,097, Apr. 6, 1993, Pat. No. 5,793,332, which is a continuation of Ser. No. 804,564, Dec. 10, 1991, abandoned.

[51] Int. Cl.[6] ..... H01Q 1/42; H01Q 21/29; H01Q 3/24

[52] U.S. Cl. ..... 343/705; 343/853; 343/872; 343/876

[58] Field of Search ..... 343/705, 708, 343/720, 725, 844, 853, 876, 895, 872; H01Q 21/28, 21/29, 21/30, 25/00, 3/20, 3/22, 3/24, 3/26, 3/28, 3/30, 3/32, 3/34, 3/36, 3/38, 3/40, 3/42, 3/44

[56] References Cited

U.S. PATENT DOCUMENTS

| | | | |
|---|---|---|---|
| 4,922,257 | 5/1990 | Saito et al. | 342/377 |
| 5,434,580 | 7/1995 | Raguenet et al. | 343/725 |

FOREIGN PATENT DOCUMENTS

| | | | |
|---|---|---|---|
| 0217702 | 5/1990 | Japan | H01Q 3/30 |
| 0281803 | 11/1990 | Japan | H01Q 3/30 |

*Primary Examiner*—Peter Toby Brown
*Attorney, Agent, or Firm*—Baker & Botts, L.L.P.

[57] ABSTRACT

A fixed body wide field-of-view conformal antenna array suitable for broadband precision direction finding on missile platforms. The array is configured as multiple sub-arrays of spiral antennas that cover particular regions within the desired field-of-view of the entire array. A lower cost, more reliable and more accurate direction finding solution for missile needs is provided, primarily by the elimination of conventional radomes and antenna gimbal structures. The array can be configured to include multi-mode sensors.

4 Claims, 5 Drawing Sheets

WIDE FIELD-OF-VIEW FIXED BODY CONFORMAL ANTENNA DIRECTION FINDING ARRAY

This application is a continuation of application Ser. No. 08/044,097, filed Apr. 6, 1993, now U.S. Pat. No. 5,793,332 which is a continuation of Ser. No. 07/804,564, filed Dec. 10, 1991, now abandoned.

BACKGROUND OF THE INVENTION

1. FIELD OF THE INVENTION

This invention relates to fixed body conformal antenna systems and, more specifically, to a broad-band, wide field-of-view (FOV) direction finding (DF) interferometer array for missile type applications.

2. BRIEF DESCRIPTION OF THE PRIOR ART

High performance missile systems require highly accurate broadband DF performance such as low angle-of-arrival (AOA) error, low AOA error rates and large fields-of-view. In the prior art, the approach used to meet these requirements has been to mount an antenna array on a gimbal and to point the antenna array boresight in the direction of the target. The system generally used two fixed antennas to determine azimuth and two fixed antennas to determine elevation with the system generally switching between the two antenna pairs to constantly monitor azimuth and elevation. Maintaining the array boresight aligned with the target reduced DF errors by maintaining the targets within the useable FOV of the antenna array. Unfortunately, this approach suffered from several shortcomings which are described hereinbelow.

The use of fixed antennas permits only the look ahead type of operation and makes it difficult to recognize a target located on the ground or anywhere other than in the narrow field of view of the antenna system. Typically, an antenna array of this type has been placed upon a gimbal with array movement on the gimbal so that the array can look down for the desired target. The gimbal is then reoriented so that the boresight of the array, which is on an axis through the center of all of the antennas, is oriented at the target.

One major deficiency of the above described type of antenna system is inadequate DF performance due to amplitude and phase perturbations induced on the direction finding antennas by the multipath reflections between the bulkhead and gimbal structures and the radome inner surface. These multipath effects are compounded by the need to have broadband coarsely tuned radomes, reflective gimbal and missile seeker bulkhead structures and broad beam antennas.

Another deficiency encountered in a gimbal antenna system is the interaction and crosstalk between the individual antennas. This coupling corrupts the desired phase response between opposing antennas, consequently reducing the DF performance of the antenna array. The crosstalk can be caused by improperly terminated antennas which couple current onto the metallic gimbal structure and back into the other antennas.

A third problem encountered in the prior art of antenna DF systems is the need for the mechanical gimbals to point the interferometer array in the direction of the target. Gimbal systems generally increase cost and reduce reliability for long life cycle missile systems. In addition, radome cavity multipath perturbations on the antennas generally change as a function of gimbal angle, thereby creating target location variances on the DF performance within the FOV.

Also, the use of fixed antennas permits only the look ahead type of operation and makes it difficult to recognize a target located on the ground or anywhere other than in the narrow field of view of the antenna system.

Amplitude resolved phase DF processing would be a preferred DF processing approach for a low AOA error and low AOA error rate system, however the problems described above limit the ability of such systems to produce unambiguous phase DF. For an amplitude resolved phase DF process to operate properly, coarse amplitude DF angle resolution must be less than the minimum spatial phase ambiguity spacing. High axial ratio and non-linear DF transfer functions caused by the problems mentioned above force prior art systems to use amplitude only DF processing. Such systems are not capable of meeting high performance DF requirements because amplitude only DF systems typically have high polarization dependent AOA error envelopes and AOA error rates. These DF deficiencies become compounded by the problems mentioned above.

SUMMARY OF THE INVENTION

In accordance with the present invention, there is provided an antenna system having improved large FOV broadband DF performance, primarily for missile type applications. The system in accordance with the present invention also provides a higher reliability, lower cost solution for missile interferometric DF arrays than was available in the prior art. This is accomplished by eliminating the need for a gimbal and radome. The method and system used to accomplish these objectives are summarized in the basic properties described hereinbelow. The following method and system is summarized for improved DF performance in the elevation down direction and can be repeated to improve DF performance in the remaining three DF sectors.

Briefly, there is provided an array of antennas, preferably but not limited to a 3 by 2 configuration of two columns and three rows on a hemispherical structure (the discussion hereinbelow will be directed to a 3×2 antenna array, it being understood that other configurations can also be used), the antennas being conformal with the hemisphere dome or surface. Each of the antennas is pointed in a different direction whereby each antenna has its maximum sensitivity aligned with its individual boresight. The axis or boresight of each of the antennas passes through the center of the sphere upon which the hemispherical structure is based. While the discussion will be confined to spiral antennas which are preferred, it should be understood that any type of antenna can be used, preferably a broad band type of antenna and preferably a spiral type of broadband antenna.

The axis or boresight of each of the top four antennas is disposed at a predetermined angle relative to the array boresight, generally in the range of from about 20° to about 45° with an angle of 30° relative to the array boresight being preferred due to simplification of the mathematics involved by using this angle. The axis or boresight of each of the bottom two antennas is disposed at a predetermined angle relative to an axis inclined about 45° downward from the array boresight and preferably at an angle of 30° relative to the axis inclined 45° downward from the array boresight to simplify the mathematics involved. This structure replaces the radome, the gimbal, and the four antennas of prior art DF systems. It should be understood that the orientation of the antennas herein is not critical as long as such orientation is known since such orientation can be taken into account during computation.

The center of the two antenna columns is aligned with the missile elevation plane and the axis through the center of the top four antennas coincides with the missile boresight. The hemispherical surface is an electrically conductive or absorber structure which, when electrically conductive, is preferably a metallic structure, a metal plated plastic or graphite reinforced composite. This surface serves two functions, these being first, the support of the six spiral antennas, and second, the isolation by the electrically conductive hemisphere of the forward hemispherical antenna beams from any undesirable reflections that can originate from the spiral backlobes.

Each antenna is surrounded by an absorber ring that is used to isolate each antenna from undesirable surface currents which may adversely affect antenna performance. In addition, each antenna is covered by a low dielectric cover of a thermosetting or thermoplastic nonmetallic material that may be reinforced with glass or quartz for additional strength. Any engineering plastic that can stand up to the environment and which shields the antenna from the environment can be used with polypropylene being preferred.

The six antennas operate as two basic four element sub-arrays with displaced boresight locations, these being the look forward and the look down sub-arrays. The top and middle rows of the antennas comprise the look forward sub-array and the are used to form DF information in the forward DF sector. The look forward boresight is aligned with the missile boresight. The middle and bottom rows of the antennas comprise the look down sub-array and perform DF in the elevation down DF sector. The look down boresight is displaced from the look ahead boresight in the negative elevation direction. Two microwave switches are used to switch between the top and bottom rows of antennas and the middle row of antennas is shared for both modes of operation.

Direction finding (DF) information is first produced in the antenna planes which are rotated 45° from the azimuth and elevation planes. The antenna planes are planes through the array boresight and the center of two antennas, one antenna from each of the two columns which are from different rows of the array. An amplitude resolved phase DF technique is employed for this invention because of its high DF performance capability. Euler angle transformations are used to rotate the antenna plane DF information back into the vehicle coordinate system in standard manner.

DESCRIPTION OF THE PREFERRED EMBODIMENT

Figure 1A:
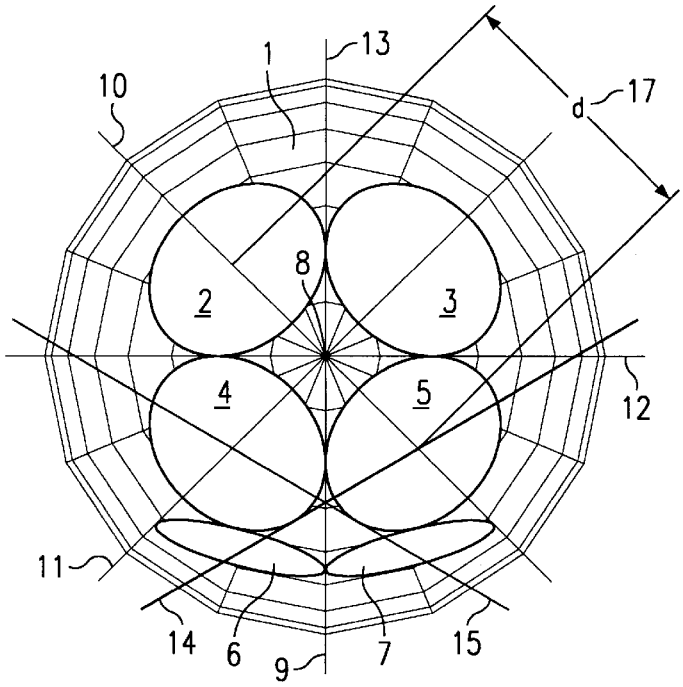
FIG. 1A and 1B are plan and elevation views respectively of the conformal antenna array in accordance with the present invention.
Figure 1B:
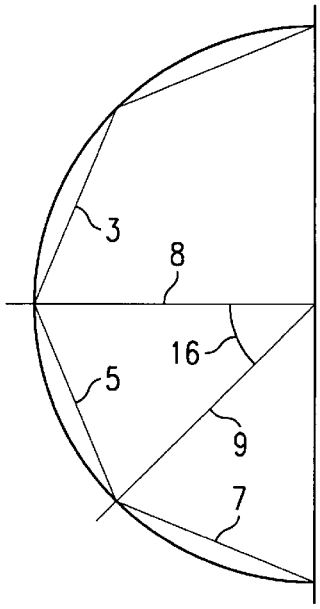

Referring now to the drawings, FIGS. 1A and 1B show the plan view of the six two arm spiral antennas 2 to 7 mounted on the aluminum hemispherical missile nose piece 1. The top four antennas 2, 3, 4 and 5 are used in the look ahead mode of operation while the bottom four antennas 4, 5, 6 and 7 are used in the look down mode of operation, with antennas 4 and 5 being used in both modes of operation. The axes of the antennas 2, 3, 4 and 5 are disposed at an angle of 30° with respect to the look ahead boresight 8. The look ahead array boresight 8 is co-aligned with the missile boresight and the look down boresight 9 is displaced from the look ahead boresight in the negative elevation direction by 45 degrees. The antennas 6 and 7 are disposed at an angle of 30° with the look down boresight 9. Antennas 4 and 5 are disposed at an angle of 30° with respect to both boresight axes 8 and 9. The axes of all of the antennas 2 to 7 intersect at the center 19 of the sphere containing the hemisphere 18.

For look ahead operation, antenna elements 5 and 2 are compared to form an AOA estimate in antenna plane 10. Antenna plane 10 contains the centers of antenna elements 5 and 2 as well as the look ahead boresight 8. In addition, antenna elements 3 and 4 are ratioed to form an AOA estimate in antenna plane 11. Antenna plane 11 contains the centers of antenna elements 3 and 4 as well as look ahead boresight 8 and is orthogonal to antenna plane 10. A standard Euler angle transformation is performed to rotate the antenna plane AOA estimates into the vehicle azimuth plane 12 and elevation plane 13. The rotation is 45° about the look ahead boresight.

In the look down mode, antenna elements 5 and 6 are ratioed to form an AOA estimate in antenna plane 14 and antenna elements 7 and 4 are ratioed to form an AOA estimate in the antenna plane 15 which is orthogonal to antenna plane 14.

Figure 2:
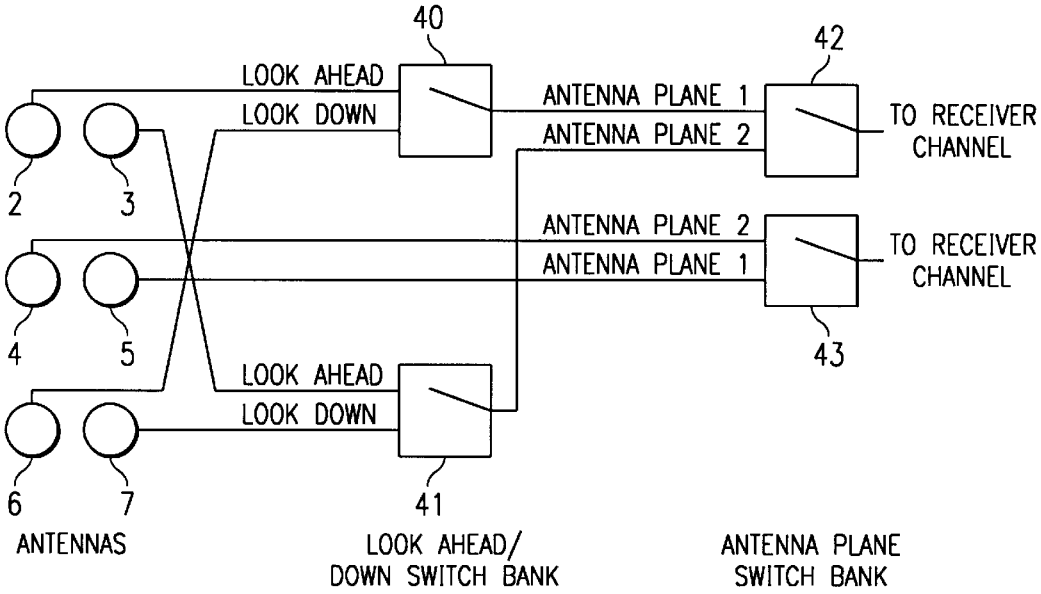
FIG. 2 is a diagram of the switching network employed in accordance with the present invention.

The microwave switching network shown in FIG. 2 is used to switch from antennas 2 and 3 in the look ahead mode to antennas 6 and 7 in the lookdown mode as will be described hereinbelow. To obtain superior performance antennas 2, 5 and 6 comprise one matched antenna set and antennas 3, 4 and 7 comprise the other matched antenna set. The same Euler angle transformations are used to provide an azimuth AOA estimate and an offset elevation AOA estimate. The elevation AOA estimate for this mode is offset from the vehicle elevation plane by the angle delta 16 shown in FIG. 1B which is the angle between the look ahead boresight axis 8 and the look down boresight axis 9.

The AOA estimates are formed using an amplitude resolved phase DF processing method. The phase response between the compared antennas is modeled as a sine function and the amplitude difference between two compared antennas is modeled using a linear approximation. These relationships are described below.

For the amplitude:

$$O_{cr}=\text{Amp_ratio}/\text{Amp_slope}-\text{Boresight_amp_comp} \quad (1)$$

Where: $O_{cr}$ is the coarse amplitude AOA estimate in the antenna plane;

Amp_ratio is the measured amplitude difference of the two compared antennas;

Amp_slope is the calculated slope of the amplitude transfer function; and

Boresight_amp_comp is the measured amplitude difference at the array boresight.

For the phase:

$$=(360\times d(\text{Sin } O)/)+N\times 360-\text{boresight_phase_comp} \quad (2)$$

Where: is the measured phase difference between the two compared antenna;

d is the physical distance between the two compared antennas (e.g., 17)

O is the fine AOA estimate in the interferometer plane;

N is the phase ambiguity integer;

Boresight_phase_comp is the measured phase difference at the array boresight; and is the wavelength of the measured signal.

In the preceding description, $O_{cr}$ is first solved in Equation (1) hereinabove and then substituted into Equation (2) as O to solve for N. Equation (2) hereinabove is then re-evaluated to solve for O. In order to accurately resolve all phase ambiguities with the coarse amplitude DF, the following criteria must be met:

For /d<1.0

$$\text{Axial_ratio/Amp_slope} < \text{Sin}^{-1}(\ /d) \quad (3)$$

Axial_ratio=ratio of the major axis to the minor axis of the incident source polarization ellipse.

Meeting the preceding criteria ensures that the coarse amplitude DF will be fine enough to resolve the smallest phase ambiguities.

The system described in this invention requires four sets of compensation values for each array axis. The compensation values are array boresight phase differences and d for the phase and array boresight amplitude difference and slope for the amplitude. These compensation values can be calculated at boresight and +/−15° in each antenna plane.

The Euler angle transformations used in this invention are shown below in their final form.

$$Az = \text{Sin}^{-1}[(½)^{1/2} \times (\text{Sin}(O_1) + \text{Sin}(O_2))] \quad (4)$$

$$E1- = \text{Sin}^{-}[(½)^{1/2} \times (-\text{Sin}(O_1) + \text{Sin}(O_2))] \quad (5)$$

Where: $O_1$=Angle of arrival in antenna plane 10(15) (FIG. 1A) for the look ahead (down) mode;

$O_2$=Angle of arrival in antenna plane 11(14) (FIG. 1A) for the look ahead (down) mode; and =The angle between the look ahead boresight 8 and the look down boresight 9 for the look down mode only ( =O for the look ahead mode).

Referring now to FIG. 2, there is shown a microwave switching network to switch from antennas 2 and 3 in the look ahead mode to antennas 6 and 7 in the look down mode. There is shown a first switch 40 which connects antenna 2 to the switch 42 in the look ahead mode and connects antenna 6 to switch 42 in the look down mode. The switch 41 connects antenna 3 to the switch 42 in the look ahead mode and connects antenna 7 to the switch 42 in the look down mode. The antennas 4 and 5 are always connected to the switch 43. The switch 43 can switch between antennas 4 and 5 whereas switch 42 can switch between the outputs of switches 40 and 41.

It is further noted that the switching arrangement shown in FIG. 2 can be eliminated and that the output of each antenna or sensor constantly be sent directly to a processor whereat the outputs are individually collected, operated upon and utilized to provide the desired information and perform the desired functions without the requirement of the switching arrangement. This is accomplished using plural channel receivers which are coupled to the individual antennas.

Figure 3:
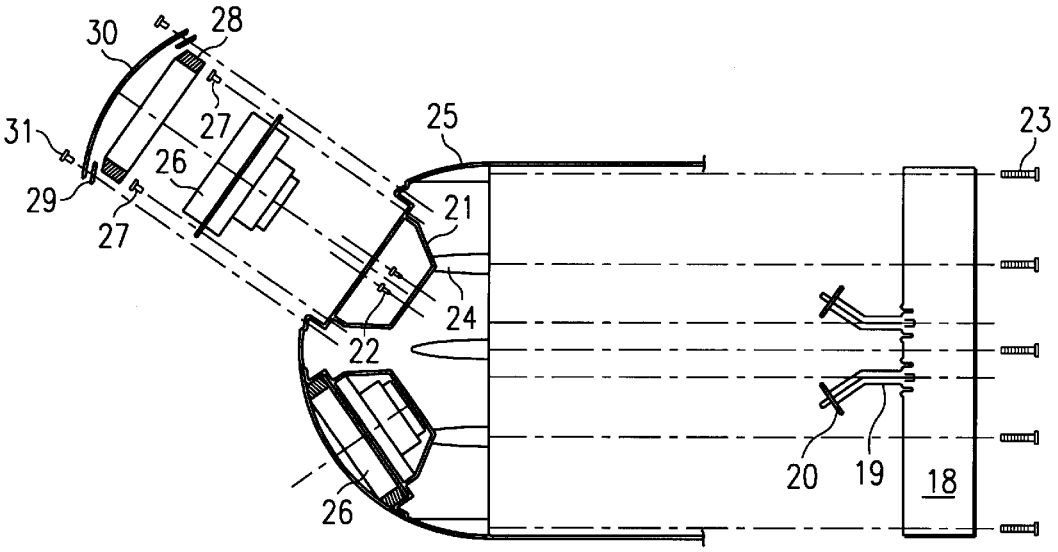
FIG. 3 is an exploded cross sectional view of the antenna system in accordance with the present invention.

FIG. 3 illustrates a cross section of the antenna array of the present invention along plane 13 and normal to plane 12 defined in FIG. 1. The microwave switching network (FIG. 2) and other electronics are contained in the receiver module 18. Attached to the receiver module are preformed phased matched cables 19. The phase matched cables 19 use blind mate press on RF connectors 20 which are guided into antenna holding cups 21. The press on connectors 20 are secured to the holding cup 21 bases by screws 22. The receiver module 18 is held in place by screws 23 that screw into bosses 24. The bosses 24, like the antenna holding cups 21, are integral components of the hemispherical dome 25.

Figure 4:
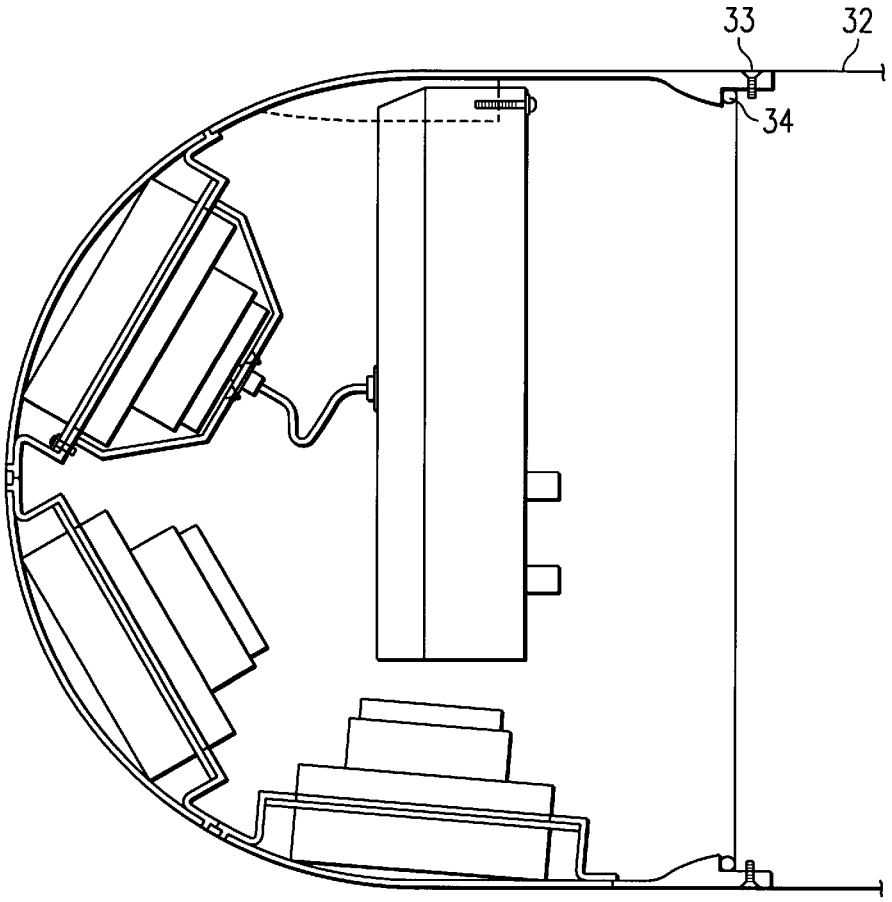
FIG. 4 is an elevation view of the assembled conformal antenna array in accordance with the present invention.

Once the receiver module 18 is secured to the hemispherical structure 25, the antennas 26 are inserted into the antenna holding cups 21. Antenna mounting screws 27 secure the antennas 26 to the antenna holding cups 21. Absorber rings 28 are placed around the antennas 26 to absorb skin currents that may adversely perturb antenna performance. A weather seal gasket 29 is placed on the lip of the antenna holding cup 21 before the antenna cover 30 is secured to the hemispherical dome 25 with antenna cover mounting screws 31. The antenna covers 30 provide an environmental shield for the antennas 26 and are fabricated of structurally reinforced low dielectric polypropylene material. Attachment of the antenna cover mounting screws 31 completes the assembly of the described invention as shown in FIG. 4. At this time, the described invention can be slid over the front of a missile bulkhead 32 and secured in place with assembly mounting screws 33 and O-ring 34.

Figure 5A:
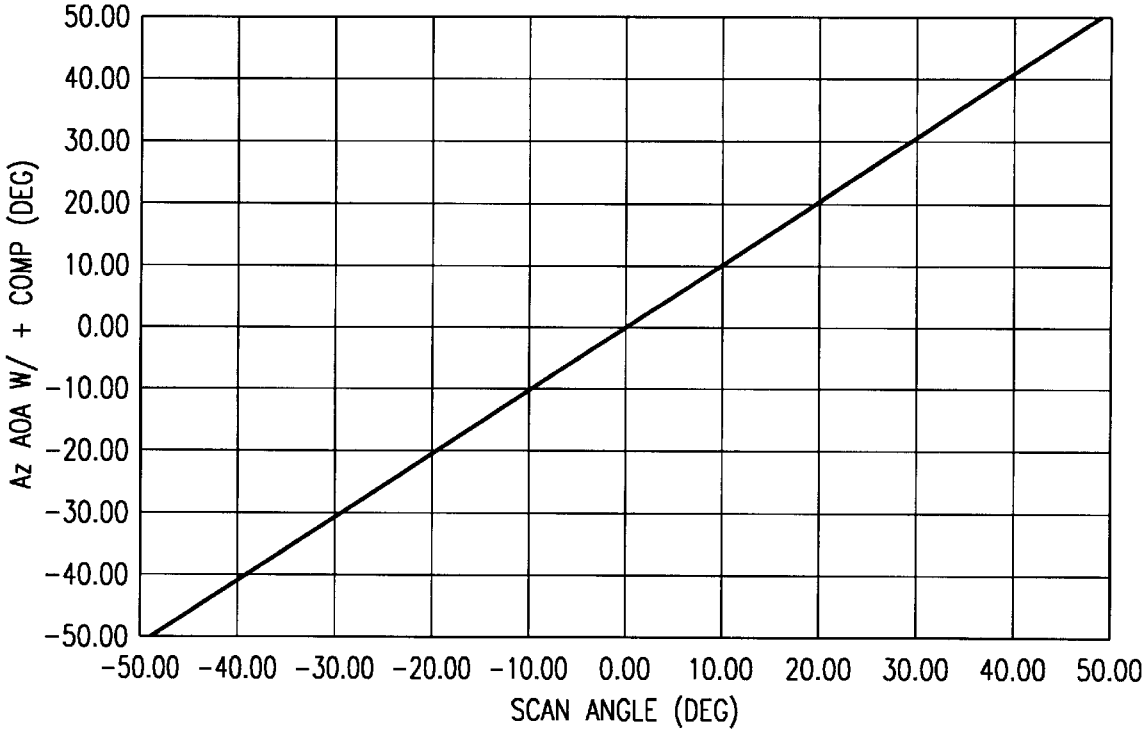
FIGS. 5A and 5B illustrate typical azimuth and elevation performance respectively of the antenna system in accordance with the present invention against a rotating linear source polarization.
Figure 5A:
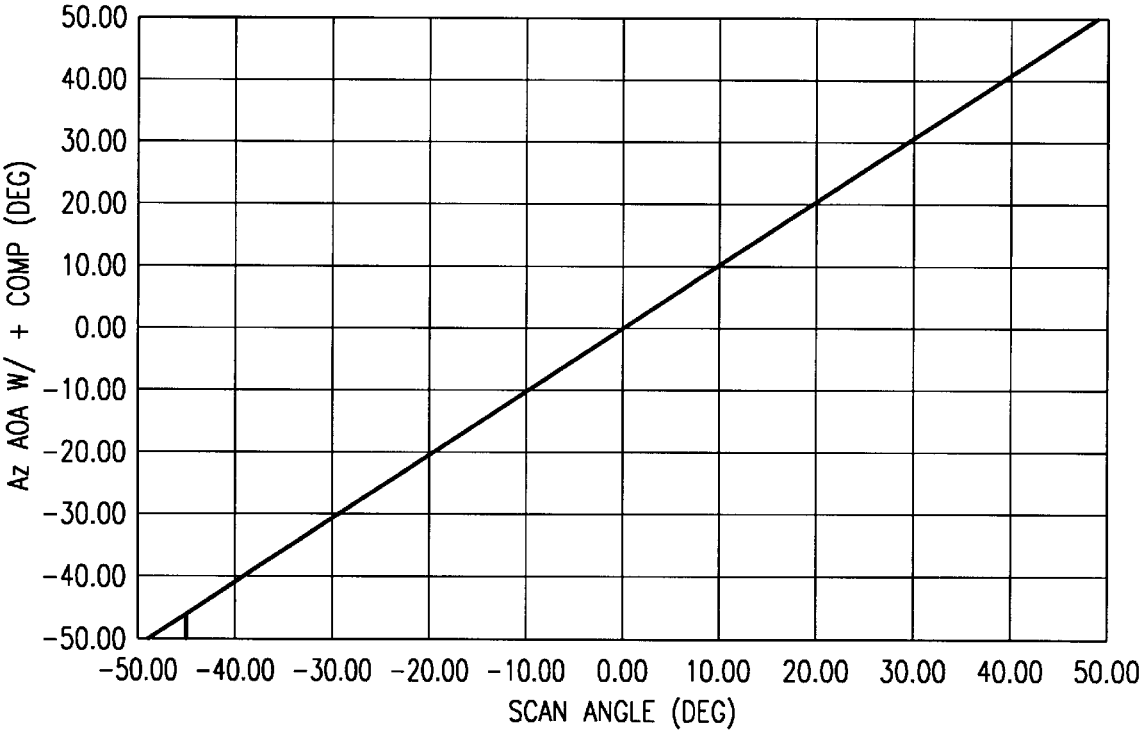
Figure 5B:
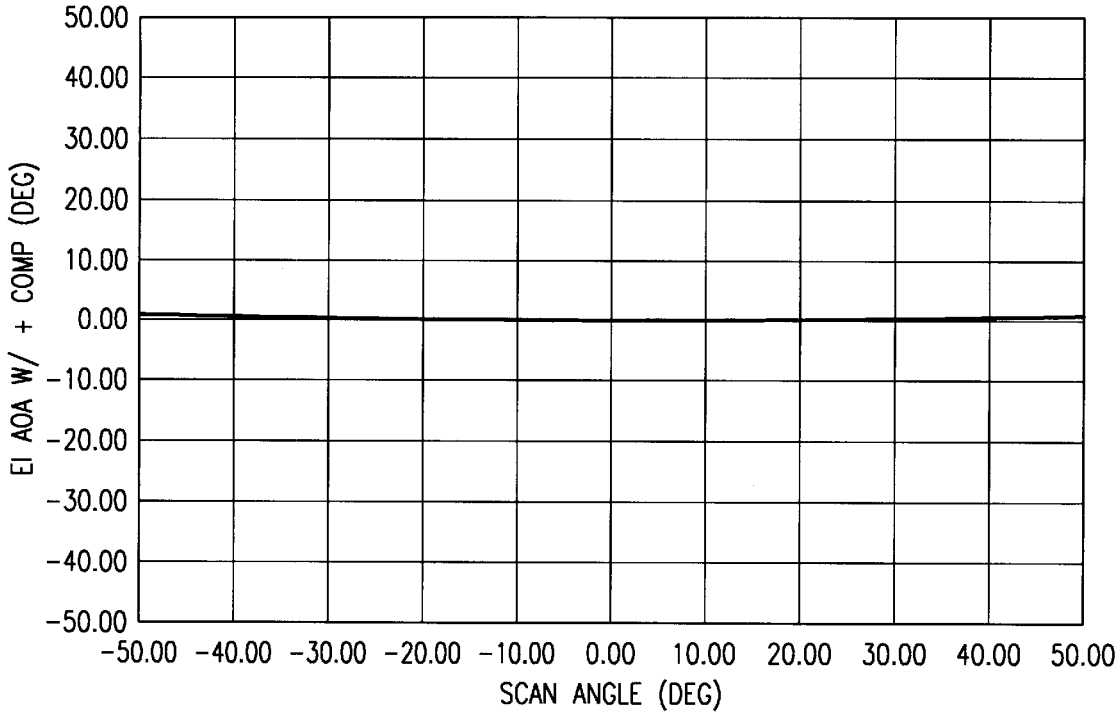
Figure 5B:
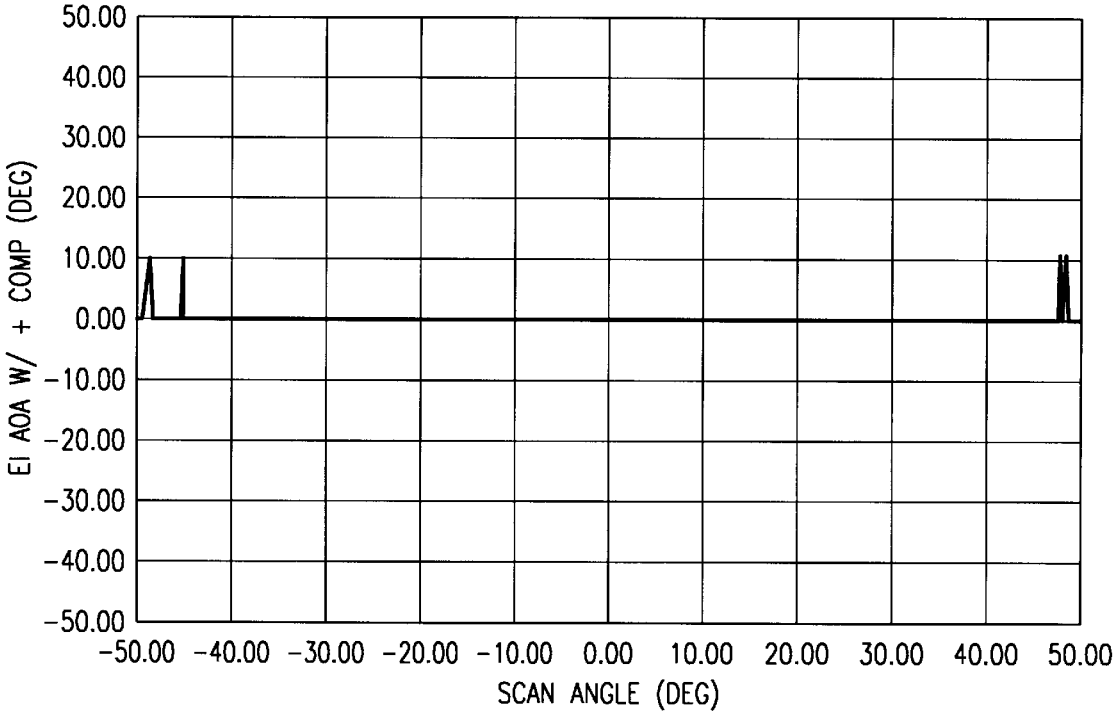

When constructed and operated as set forth above, the conformal array will provide azimuth and elevation angle of arrival (AOA) information as illustrated in FIGS. 5A and 5B wherein the left figure in each case shows results at one frequency and the right figure in each case shows results at another frequency. The azimuth plots in FIG. 5A show very accurate AOA, particularly within +/−40° of boresight, at two different frequencies. The elevation plots of FIG. 5B show very accurate AOA performance, particularly within +/−45° of boresight. The theoretical value in FIG. 5B is zero, thus accounting for the failure to see any data graphed in the left figure. These plots are actual measured data of an azimuth scan at zero elevation.

Figure 6:
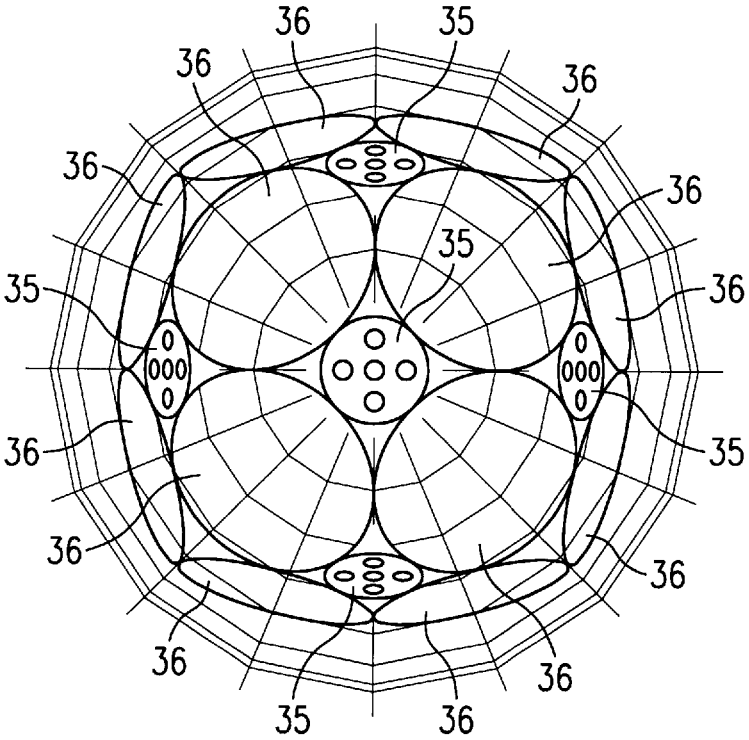
FIG. 6 illustrates alternate applications of the present invention.

Although a particular arrangement of conformal spiral antenna array has been illustrated for the purpose of describing the manner in which the invention can be applied, it will be appreciated that the invention is not limited as such. FIG. 6 illustrates how the described arrangement can be expanded to provide full forward hemisphere FOV coverage by adding up to six more antennas to include look up, look left and look right arrays in addition to the look ahead and look down capability as described herein. FIG. 6 also illustrates, for example, the described invention supporting alternate mode sensors 35, such as millimeter wave antenna or infrared sensors disposed in the interstices between antennas 36 and preferably at the surface region of the hemisphere 37 to further enhance the operational capability of the described invention. For example, the antenna array composed of antennas 36 can be of the type described hereinabove with reference to FIGS. 1A and 1B whereas the antenna array composed of antennas or sensors 35 can be arranged to operate in the same manner as the array composed of antenna elements, but be designed to sense a form of energy or the like different from that sensed by other antenna array. For example, the first antenna array can be designed to detect standard RF energy to direct the array carrying device to a location close to the target whereupon the second antenna array, which can be infrared sensors or detectors, can be switched in to more accurately locate and/or define the target and perform desired operations against the target as a result of such location and/or definition.

Though the invention has been described with respect to certain particular preferred embodiments thereof, many variations and modification thereof will immediately become apparent to those skilled in the art. It is therefore the intention that the appended claims be interpreted as broadly as possible in view of the prior art to include all such variations and modifications.

We claim:

1. An antenna array for use in a mobile airborne system which comprises:

(a) a substantially hemispherical surface;

(b) a look ahead antenna system, said look ahead antenna system pointed to transmit and/or receive radiations along a path being traversed by said mobile airborne system, said look ahead antenna system comprising a plurality of antennas spaced about a first axis and conformal to said hemispherical surface;

(c) a look down antenna system comprising a plurality of antennas, selectively including at least one antenna of said look ahead antenna system, spaced about a second axis and conformal to said hemispherical surface, said second axis displaced with respect to said first axis;

(d) said look ahead antenna system and said look down antenna system each including antennas common to both said look ahead antenna system and said look down antenna system, said common antennas being selectively couplable to one of said look ahead antenna system and said look down antenna system; and (e) a switching network for selectively coupling one of said look ahead antenna system or said look down antenna system to a utilization device for utilization of the output of the antenna system coupled thereto.

2. An array as set forth in claim 1 wherein said look ahead antenna system consists of four antennas symmetrically spaced about said first axis and said look down antenna system consists of four antennas symmetrically spaced about said second axis, two of said antennas of said look ahead antenna system and two of said antennas of said look down antenna system being common to each of said antenna systems.

3. An array as set forth in claim 1 wherein each of said antennas has an antenna axis, the antenna axes of said antennas of said look ahead antenna system disposed at an angle of about 30° with respect to said first axis and the antenna axes of said antennas of said look down antenna system disposed at an angle of about 30° with respect to said second axis.

4. An array as set forth in claim 2 wherein each of said antennas has an antenna axis, the antenna axes of said antennas of said look ahead antenna system disposed at an angle of about 30° with respect to said first axis and the antenna axes of said antennas of said look down antenna system disposed at an angle of about 30° with respect to said second axis.

* * * * *

UNITED STATES PATENT AND TRADEMARK OFFICE

CERTIFICATE OF CORRECTION

PATENT NO. : 5,818,393
DATED : October 6, 1998
INVENTOR(S) : Fowler et al.

It is certified that error appears in the above-identified patent and that said Letters Patent is hereby corrected as shown below:

Column 3, line 23, after "and" delete "the", and insert --they--.

Column 5, line 33, after "E1-=", delete "Sin$^{-}$" and insert --Sin$^{-1}$--.

Signed and Sealed this

Third Day of August, 1999

*Attest:*

*Attesting Officer*

Q. TODD DICKINSON

*Acting Commissioner of Patents and Trademarks*